US007235210B2

(12) United States Patent
Nakashima

(10) Patent No.: US 7,235,210 B2
(45) Date of Patent: Jun. 26, 2007

(54) METAL MELTING FURNACE

(75) Inventor: Mitsukane Nakashima, Aichi (JP)

(73) Assignee: Kabushiki Kaisha Meichu (JP)

( * ) Notice: Subject to any disclaimer, the term of this patent is extended or adjusted under 35 U.S.C. 154(b) by 46 days.

(21) Appl. No.: 11/175,371

(22) Filed: Jul. 7, 2005

(65) Prior Publication Data

US 2006/0027953 A1 Feb. 9, 2006

(30) Foreign Application Priority Data

Aug. 4, 2004 (JP) ..... 2004-228143
Jun. 8, 2005 (JP) ..... 2005-168214

(51) Int. Cl.
*C21C 7/00* (2006.01)
*C21B 7/00* (2006.01)

(52) U.S. Cl. ..... 266/242; 266/900; 432/158

(58) Field of Classification Search ..... 266/242, 266/900; 432/158, 156
See application file for complete search history.

(56) References Cited

U.S. PATENT DOCUMENTS 4,353,532 A * 10/1982 Jay ..... 266/242
4,455,016 A * 6/1984 Urdea ..... 266/242
4,974,817 A * 12/1990 Nakashima ..... 266/900
7,060,220 B2 * 6/2006 Nakashima ..... 266/242

FOREIGN PATENT DOCUMENTS

JP 3225000 B 8/2001

* cited by examiner

*Primary Examiner*—Scott Kastler
(74) *Attorney, Agent, or Firm*—Rader Fishman & Grauer PLLC

(57) ABSTRACT

There is provided a novel construction of a metal melting furnace that can preheat and melt the entire material more efficiently and that can facilitate operations for removing oxides deposited on the surface around the melting burner and the inside thereof and thus reduce the time for cleaning the inside of the furnace. The metal melting furnace 10 includes a melting chamber 20 that has a material charging port 21 and a flue 22 at the top and a hearth section 25 along which melted material flows down to a molten material holding section 60 at the bottom, wherein a combustion chamber 30 equipped with a melting burner 35 is formed below the hearth section 25, a heating plate 40 comprised of a heat-resistant plate having high heat conductivity is disposed in the hearth section 25 above the combustion chamber 30, and an exhaust gas outflow passage 50 from the combustion chamber 30 is formed in a side wall of the melting chamber 20.

8 Claims, 12 Drawing Sheets

METAL MELTING FURNACE

BACKGROUND OF THE INVENTION

1. Field of the Invention

The present invention relates to a metal melting furnace such as that for aluminum and the like.

2. Description of the Related Art

The present inventor previously proposed a metal melting furnace 100 shown in FIGS. 10–12. This is a melting furnace 100 in which material to be melted is inserted into a preheating flue 122 having a material charging port 121 formed at the top thereof and an inclined hearth section 125 at the bottom thereof and, then, the material is heated and melted by a melting burner 135 disposed toward the lower portion of the preheating flue 122 and introduced into a molten material holding section 160 via the hearth section 125 and, in the molten material holding section 160, the molten material M is kept at a predetermined temperature by a holding burner 165, wherein a melted material holding member 115 having an open bottom is disposed in the preheating flue 122 so that there is a clearance C between the melting burner 135 and a furnace wall surface 111W at the opposite side in the flue 122. (for an example, see Japanese Patent No. 32250000)

In the figures, there are shown a furnace wall 111 defining the preheating flue 122, an inspection hole 112 formed on the furnace wall 111, a door 113 of the inspection hole 112, a flange section 116 provided at the top of the melted material holding member 115, a partition 126 between the preheating flue 122 and the molten material holding section 160, and a communicating opening 127 formed through the partition 126. Further, in connection with the molten material holding section 160, there are shown a furnace wall 161 defining the molten material holding section, an inspection hole 162 formed on the furnace wall 161, a door 163 of the inspection hole 162, a molten material discharge section 170, and a communicating opening 171 formed at the bottom of the partition between the molten material holding section 160 and the molten material discharge section 170.

In the conventional metal melting furnace 100 of this type, the melting burner 135 is typically disposed toward the bottom of the preheating flue 122 so that burner flame of the melting burner 135 hits the material to be heated and melted directly. The material naturally starts melting from the portion hit by the burner flame directly, but in a position where the burner flame of the melting burner 135 does not hit directly or adequately or, more specifically, for example, in a position adjacent to the hearth section 125 and a position at the opposite side of the melting burner 135, it may be hard to melt the material and, in some cases, the material may remain unmelted to the end.

Further, in the conventional metal melting furnace 100 in which the melting burner 135 is disposed on the furnace wall 111, when the burner flame hits the material to be melted directly, sherbet-like half-melted material may be scattered to deposit as oxides on the surface around the melting burner 135 and the inside thereof and, therefore, the oxides may have to be removed regularly.

In these respects, in the metal melting furnace of this type, it has been strongly desired to preheat and melt the entire material more efficiently and to facilitate operations for removing the oxides deposited on the surface around the melting burner and the inside thereof.

Japanese Patent No. 3225000

SUMMARY OF THE INVENTION

In view of the above problems, the present invention has been made to provide a novel construction of a metal melting furnace that can preheat and melt the entire material more efficiently and that can facilitate operations for removing oxides deposited on the surface around the melting burner and the inside thereof and thus reduce the time required for cleaning the inside of the furnace.

Thus, according to the present invention, there is provided a metal melting furnace including a melting chamber that has a material charging port and a flue at the top and a hearth section along which melted material flows down to a molten material holding section at the bottom, wherein a combustion chamber equipped with a melting burner is formed below the hearth section, a heating plate comprised of a heat-resistant plate having high heat conductivity is disposed in the hearth section above the combustion chamber, and an exhaust gas outflow passage from the combustion chamber is formed in a side wall of the melting chamber so that an outlet of the outflow passage is opened to the melting chamber.

According to the present invention, in the metal melting furnace, the exhaust gas outflow passage is formed by a groove section provided on the side of a furnace main body and a side wall member and the outlet is formed at the top of the side wall member.

According to the present invention, in the metal melting furnace, the side wall member and the heating plate are formed integrally as a heating member that has a U-shape when viewed from the side and the heating member is disposed in the furnace main body.

According to the present invention, in the metal melting furnace, a furnace upper part above the outlet at the top of the side wall member can be separated from the furnace main body and, when the furnace upper part is separated from the furnace main body, the heating member can be detached from the furnace main body.

According to the present invention, in the metal melting furnace, a melted material holding member, the bottom of which is opened from the flue to the melting chamber, is provided.

According to the present invention, in the metal melting furnace, a partition section is provided between the hearth section and the molten material holding section to store molten material temporarily so that impurities such as metal oxides are collected on the surface of the molten material, and a molten material processing section is provided for supplying clean molten material through a molten material communicating section at the bottom of the partition section.

According to the present invention, in the metal melting furnace, a bottom surface of the molten material processing section is formed at a level lower than a bottom surface of the molten material holding section and the bottom surface of the molten material holding section is formed at a level substantially flush with a bottom side of the molten material communicating section.

According to the present invention, in the metal melting furnace, an exhaust gas communicating section is formed at the upper part of the partition section to extend from the molten material holding section.

According to the present invention, in a metal melting furnace including a melting chamber that has a material charging port and a flue at the top and a hearth section along which melted material flows down to a molten material holding section at the bottom, wherein a combustion chamber equipped with a melting burner is formed below the hearth section, a heating plate comprised of a heat-resistant plate having high heat conductivity is disposed in the hearth section above the combustion chamber, and an exhaust gas outflow passage from the combustion chamber is formed in a side wall of the melting chamber so that an outlet of the outflow passage is opened to the melting chamber, the material in a position adjacent to the hearth section can be heated and melted and, at the same time, the entire material can be preheated and melted efficiently and, therefore, preheating efficiency of the melted material can be improved significantly. As a result, the problem of unmelted material residing in the furnace can be solved. Further, because the melting burner is separated from the melted material by the heating plate, sherbet-like half-melted material can be prevented from being scattered to deposit as oxides on the surface around the melting burner and the inside thereof and, therefore, operations that have been performed regularly hitherto for removing such oxides become unnecessary. As a result, the time required for cleaning the inside of the furnace can be reduced and the workability can be improved.

According to the present invention, in the metal melting furnace, wherein the exhaust gas outflow passage is formed by a groove section provided on the side of a furnace main body and a side wall member and the outlet is formed at the top of the side wall member, the exhaust gas outflow passage and its outlet can be formed simply and reliably and, therefore, its manufacturing costs can be reduced. As described later, another advantage can also be obtained by selecting the material of the side wall member.

According to the present invention, in the metal melting furnace, wherein the side wall member and the heating plate are formed integrally as a heating member that has a U-shape when viewed from the side and the heating member is disposed in the furnace main body, the melting chamber can be constructed easily and reliably and the manufacturing costs can be reduced. Further, durability can be improved and the melted material can be prevented from leaking from the melting chamber.

According to of the present invention, in the metal melting furnace wherein a furnace upper part above the outlet at the top of the side wall member can be separated from the furnace main body and, when the furnace upper part is separated from the furnace main body, the heating member can be detachable from the furnace main body, the heating member can be replaced very easily and the maintainability of the melting furnace itself can also be improved significantly.

According to the present invention, in the metal melting furnace, wherein a melted material holding member, the bottom of which is opened from the flue to the melting chamber, is provided, it is possible to reduce complicated and difficult operations for removing and cleaning unmelted material that remains deposited in the melting chamber and, therefore, the durability of the furnace body can be improved and, at the same time, the preheating efficiency of the melted material and, thus, the productivity can be increased.

According to the present invention, in the metal melting furnace, wherein a partition section is provided between the hearth section and the molten material holding section to store molten material temporarily so that impurities such as metal oxides are collected on the surface of the molten material, and a molten material processing section is provided for supplying clean molten material through a molten material communicating section at the bottom of the partition section, the cleanness of the molten material in the molten material holding section can be improved and the high quality of the molten material in the molten material holding section can be maintained.

According to the present invention, in the metal melting furnace, wherein a bottom surface of the molten material processing section is formed at a level lower than a bottom surface of the molten material holding section, even if the impurities are deposited on the bottom surface of the molten material processing section for a long time, clean molten material can be supplied to the molten material holding section and the cleanness of the molten material in the molten material holding section can be maintained for a long time. Further, because the bottom surface of the molten material holding section is formed at a level substantially flush with a bottom side of the molten material communicating section, the impurities on the bottom surface of the molten material holding section and the bottom side of the molten material communicating section can be cleaned and removed easily and, at the same time, the design and construction of the furnace can be simplified so that strength and durability of the partition section can be maintained longer.

According to of the present invention, in the metal melting furnace, wherein an exhaust gas communicating section is formed at the upper part of the partition section to extend from the molten material holding section, exhaust gas from the molten material holding section can flow through the entire furnace and the exhaust gas can be utilized effectively.

DESCRIPTION OF THE PREFERRED EMBODIMENTS

Figure 1:
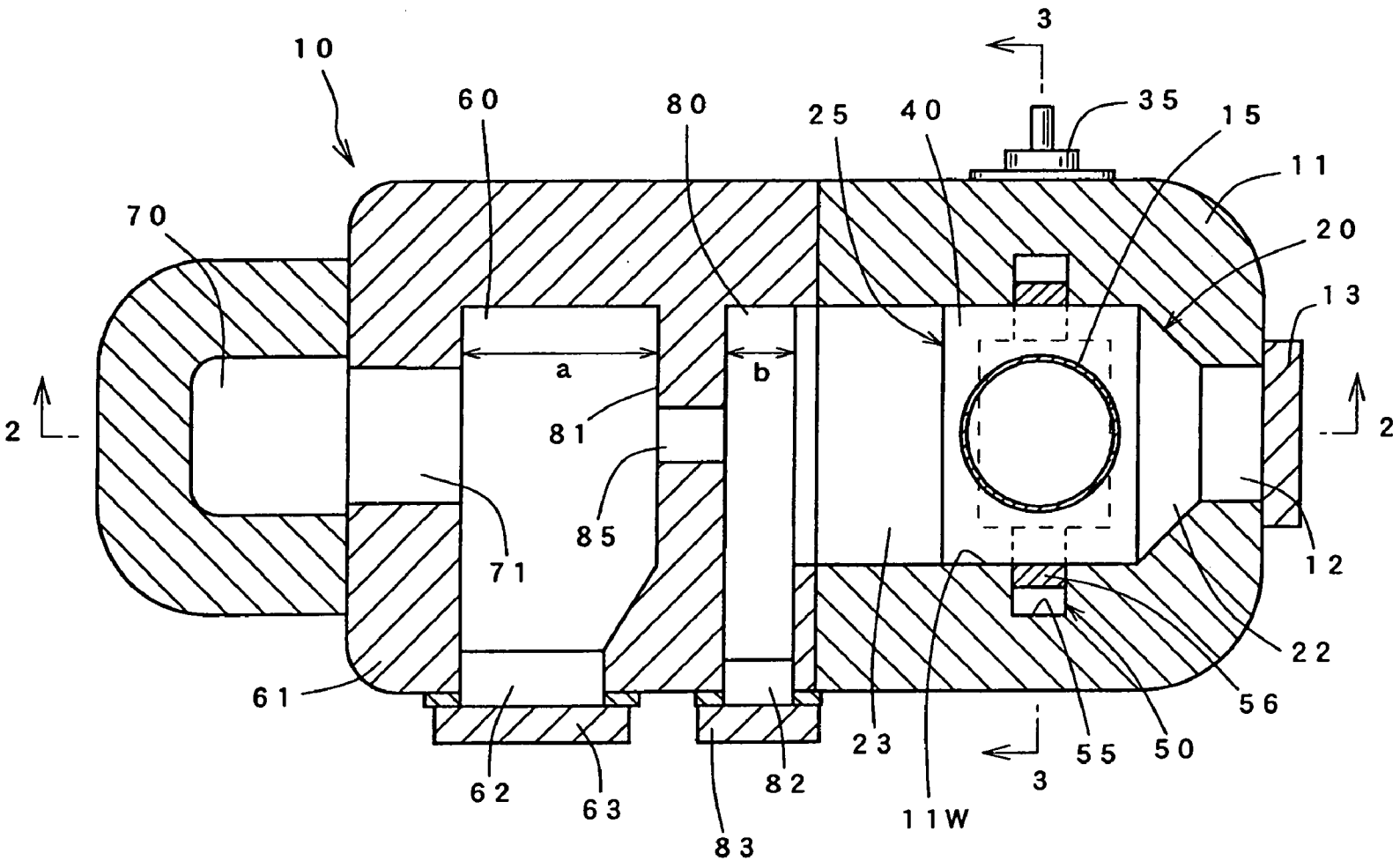
FIG. 1 is a general schematic cross-sectional view of a metal melting furnace showing an embodiment of the present invention.

Hereinafter, the present invention will be described with reference to the accompanying drawings.

A metal melting furnace 10 according to an embodiment is a so-called "local" melting furnace that melts and holds molten aluminum for aluminum casting and that, as shown in FIGS. 1–4, includes a melting chamber 20 having a material charging port (also acting as an exhaust port) 21 and a flue 22 at the top and a hearth section 25 along which material flows down to a molten material holding section 60 at the bottom. A furnace of this type is commonly referred to as a dry hearth furnace. In these figures, there are shown a furnace main body 11 defining the melting chamber 20, an inspection hole 12 formed on the furnace main body 11, a door 13 for the inspection hole 12, an inclined floor 23, and a communicating opening 24 between the melting chamber 20 and the molten material holding section 60.

Figure 2:
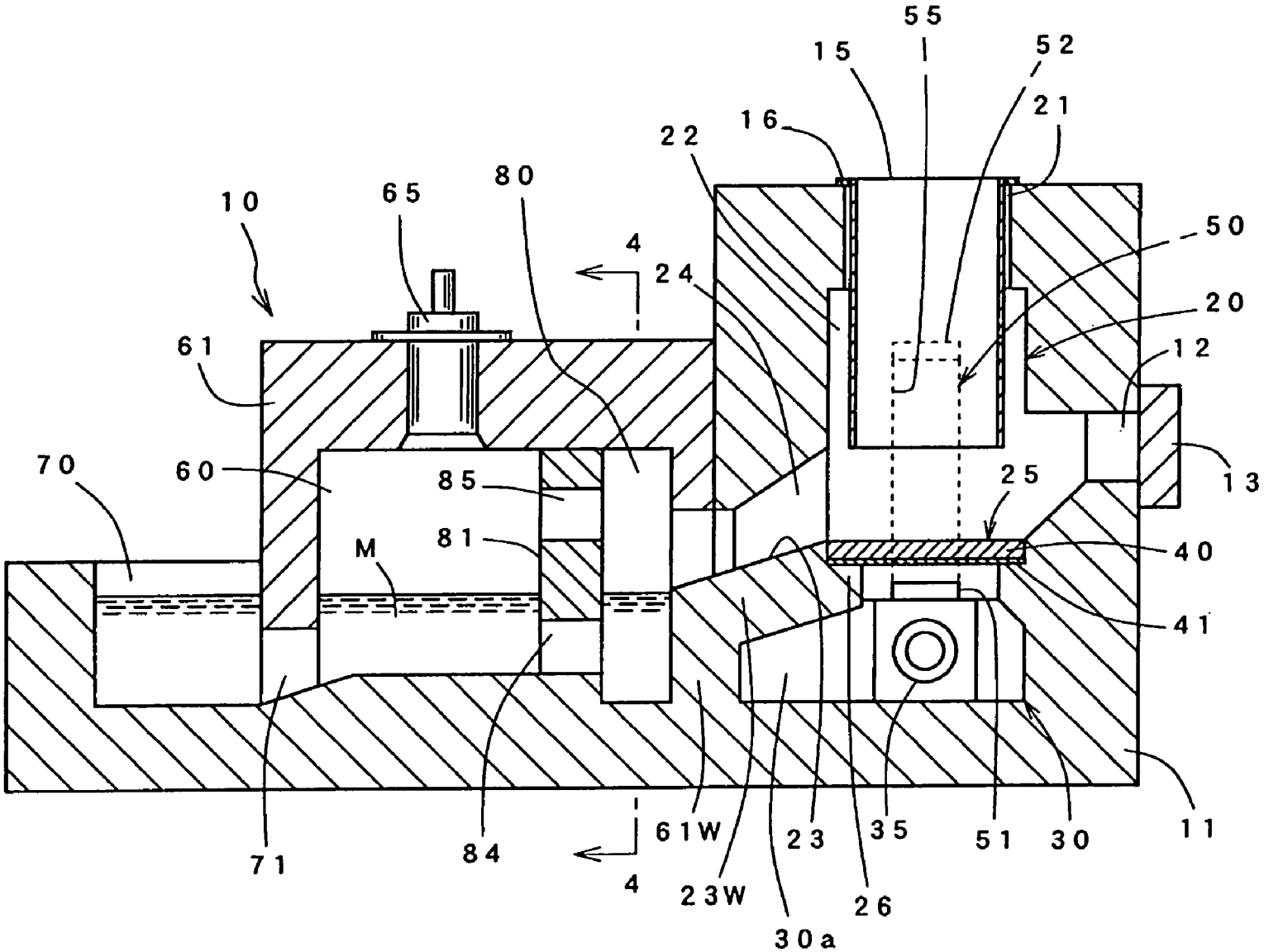
FIG. 2 is a cross-sectional view taken along the line 2—2 in FIG. 2.
Figure 3:
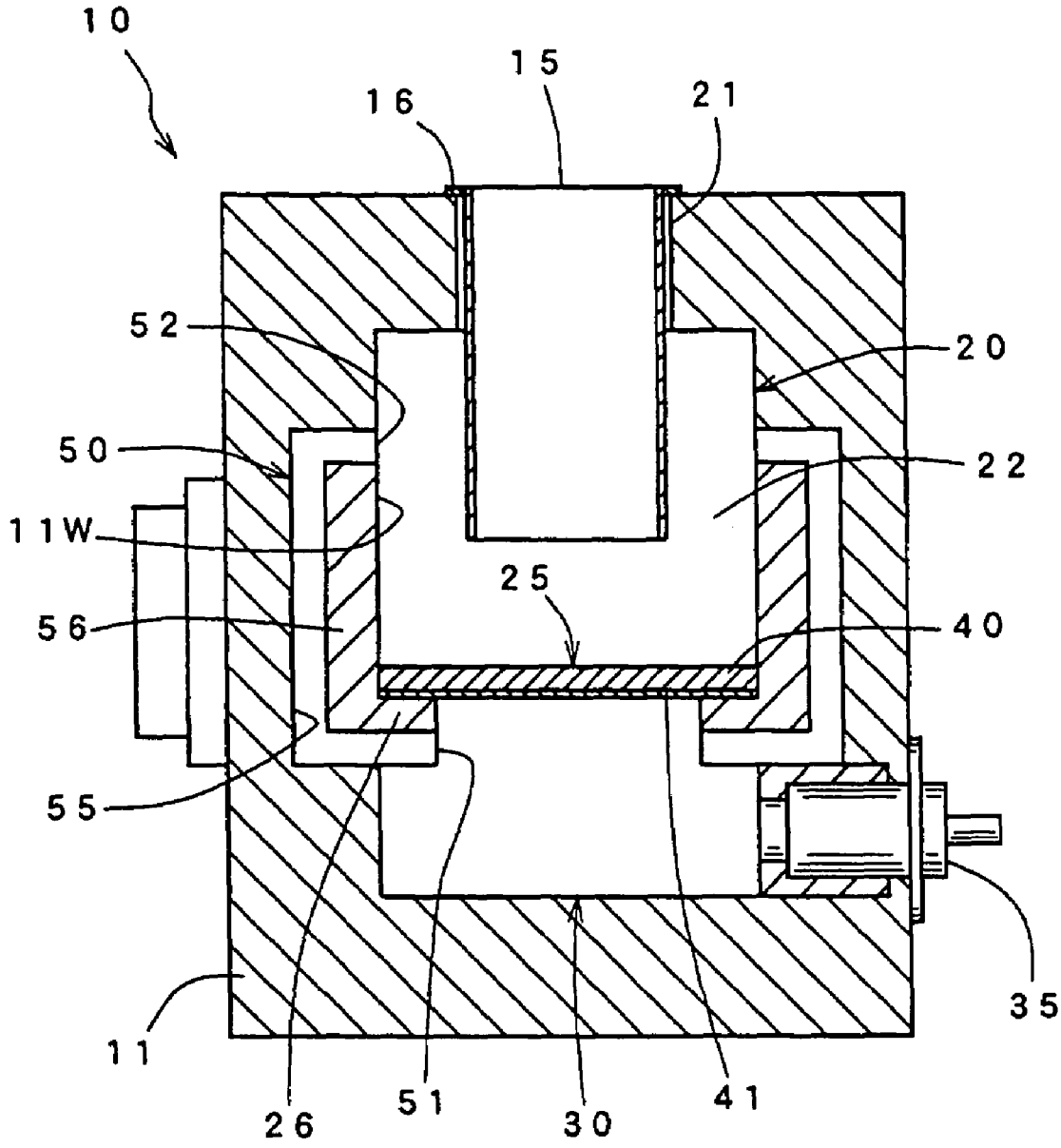
FIG. 3 is a cross-sectional view taken along the line 3—3 in FIG. 1.

In the metal melting furnace 10 of the present invention, as shown in FIGS. 2–3, a combustion chamber 30 equipped with a melting burner 35 is formed below the hearth section 25 of the melting chamber 20 and, on the other hand, a heating plate 40 comprised of a heat-resistant plate having high heat conductivity is disposed in the hearth section 25 above the combustion chamber 30 and, further, an outflow passage 50 for discharging exhaust gas from the combustion chamber 30 is formed in a side wall 11W so that an outlet 52 of the outflow passage 50 is opened to the melting chamber 20.

As described above, the combustion chamber 30 is formed below the hearth section 25 of the melting chamber 20 so that the melting burner 35 burns in the melting chamber 20 to heat the heating plate 40 explained below. In this embodiment, the burner flame of the melting burner 35, at about 1100 to 1200° C., heats the inside of the combustion chamber 30 to about 1000° C. Further, as shown in FIG. 2, a portion 30*a* of this combustion chamber 30 projects toward the molten material holding section 60 (a molten material processing section 80 in this embodiment) explained below along the inclined floor 23, so that the combustion heat in the combustion chamber 30 preheats the melted material flowing down along the inclined floor 23 and the molten material M in the molten material holding section 60 (the molten material processing chamber 80) via a hearth 23W of the inclined floor 23 and a furnace wall 61W of the molten material holding section 60 (the molten material processing section 80).

The heating plate 40 is disposed in the hearth section 25 of the melting chamber 20 above the combustion chamber 30 and, as shown in the figures, acts as the hearth of the melting chamber 20 mounted on a mount section 26 formed at the bottom of the melting chamber 20 so that the heating plate 40 is preheated by the combustion heat in the combustion chamber 30 so as to melt the material through the hearth section 25. It is desirable that the heating plate 40 can transfer the combustion heat in the combustion chamber 30 to the melted material more efficiently and, further, can withstand the combustion heat (a high temperature of about 1000° C.) in the combustion chamber 30 and, therefore, the heating plate 40 is made of a heat-resistant plate having high heat conductivity. As a material for the heating plate 40, for example, a thin heat-resistant plate made of silicon carbide (SiC), silicon nitride ($Si_3N_4$) and the like may preferably be selected and, further, such a heat-resistant plate may be combined with stainless steel (heat-resistant cast steel) disposed therebelow as a reinforcing plate 41. Further, though not shown in the figures, it is preferable that a plurality of small holes are formed in the reinforcing plate 41.

The exhaust gas outflow passage 50 is formed in the side wall 11W of the melting chamber 20 so that the exhaust gas from the combustion chamber 30 flows out through the outlet 52 opened to the melting chamber 20 so as to preheat the inside of the melting chamber 20. In this embodiment, as shown in FIG. 3, the outflow passage 50 has a substantially U-shaped cross-section and the exhaust gas, at about 1000° C., flows out through the outflow passage 50 to preheat the inside of the melting chamber 20 to about 900 to 950° C. Further, as shown in the figure, a plurality (two in this example) of outflow passages 50 may be formed to preheat the inside the melting chamber 20 more efficiently. In FIGS. 2–3, reference numeral 51 designates an inlet of the outflow passage 50.

It is preferable that this exhaust gas outflow passage 50 is formed by a groove section 55 provided on the side of the furnace main body 11 and a side wall member 56 and that the outlet 52 is formed at the top of the side wall member 56 as in the shown embodiment. Such configuration allows the exhaust gas outflow passage 50 to be formed simply and reliably. Manufacturing costs can also be reduced. When the exhaust gas of about 1000° C. passes through this outflow passage 50, the inside of the melting chamber 20 can be preheated both via the side wall member 56 and by the exhaust gas flowing out from the outlet 52 and, as a result, the entire material can be preheated and melted very efficiently. In particular, when the side wall member 56 of the outflow passage 50 is made of a material having high heat conductivity and high heat resistance as in the case of the heating plate 40, the preheating effect by the side wall member 56 can be increased further. Here, though the side wall member 56 has a width identical to that of the groove section 55 in the shown embodiment, the side wall member 56 may span the entire width of the side wall 11W.

In the metal melting furnace 10 of the present invention, as shown in the figures, it is preferable to provide a melted material holding member 15, the bottom of which is opened from the flue 22 to the melting chamber 20. By providing the melted material holding member 15, it is possible to reduce complicated and difficult operations for removing and cleaning unmelted material that remains deposited in the melting chamber 20. Further, damage to the furnace main body 11 due to the unmelted material deposited to the furnace main body 11 can be prevented and the durability can be improved. Still further, because the melted material accommodated in the melted material holding member 15 can be heated entirely from both inside and outside of the holding member 15, the preheating efficiency and, thus, productivity can be increased. In this connection, in the shown embodiment, it is to be noted that the melted material holding member 15 is positioned substantially at the center of the melting chamber 20 to prevent the melted material holding member 15 from contacting with the furnace main body 11.

Further, the melted material holding member 15 may have any configuration that can at least hold metallic material therein and, for example, it may be configured as a tubular sleeve. Then, as shown in the figures, when a flange section 16 is provided at the top end of the melted material holding member 15 to cover the edge of the material input port 21, the material can be fed easily and the input port 21 can be protected from being damaged by contact with the material when the material is fed. Also, in this case, the melting material holding member 15 of this embodiment can be installed or replaced easily in a hanging fashion and, further, a clearance between the material input port 21 of the melting chamber 20 and the opening of the melted material holding member 15 can be controlled easily.

The melted material holding member 15 may desirably be made of a material having high heat conductivity and high heat resistance as well as high shock resistance so that the holding member 15 can be exposed to a temperature of 900° C. or higher when the holding member 15 is heated from outside and so that the holding member 15 can withstand mechanical shock when the metallic material is fed. This embodiment uses a cylindrically-shaped sleeve of stainless steel (heat-resistant cast steel) of about 10 mm in thickness, to the outer surface of which alumina ($Al_2O_3$) is applied for inhibiting oxidation and increasing durability. The material for the melted material holding member 15 is not limited to this example and silicon carbide (SiC) or graphite mixtures may be used in place of alumina. Further, the melted material holding member 15 may be formed by either a porous member, a mesh member or a frame member.

Figure 4:
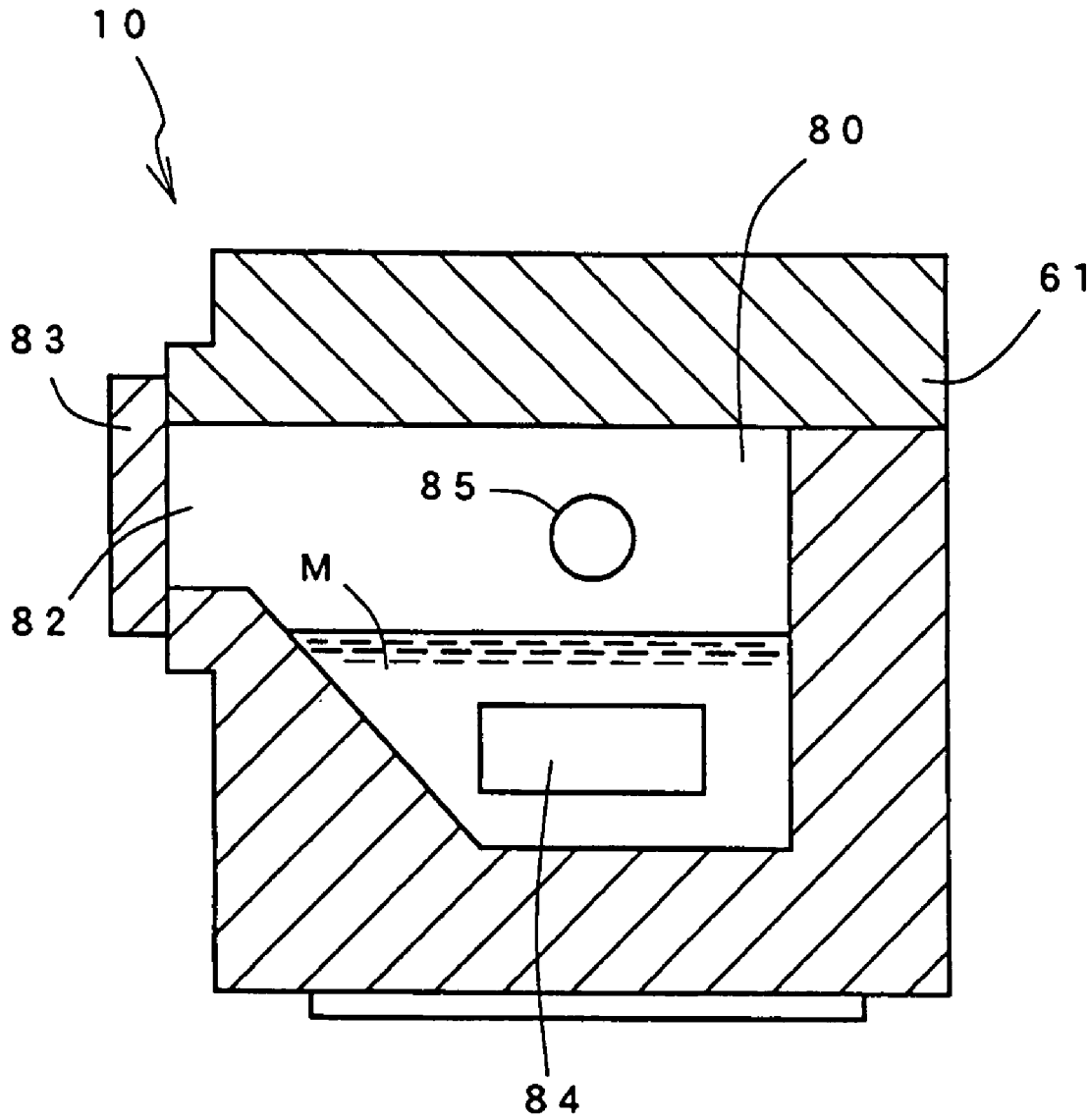
FIG. 4 is a cross-sectional view taken along the line 4—4 in FIG. 2.
Figure 5:
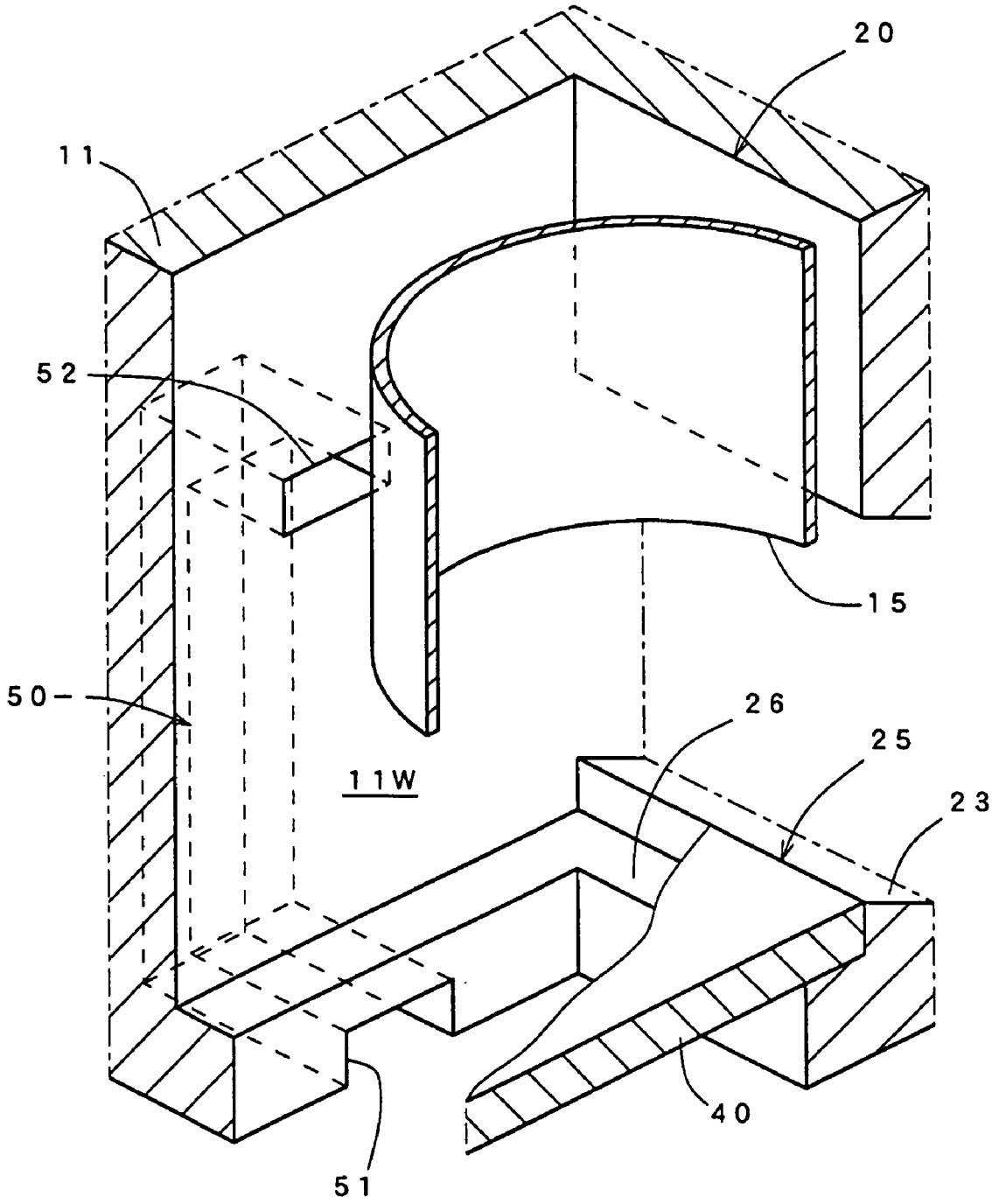
FIG. 5 is a perspective view in a melting chamber.
Figure 6:
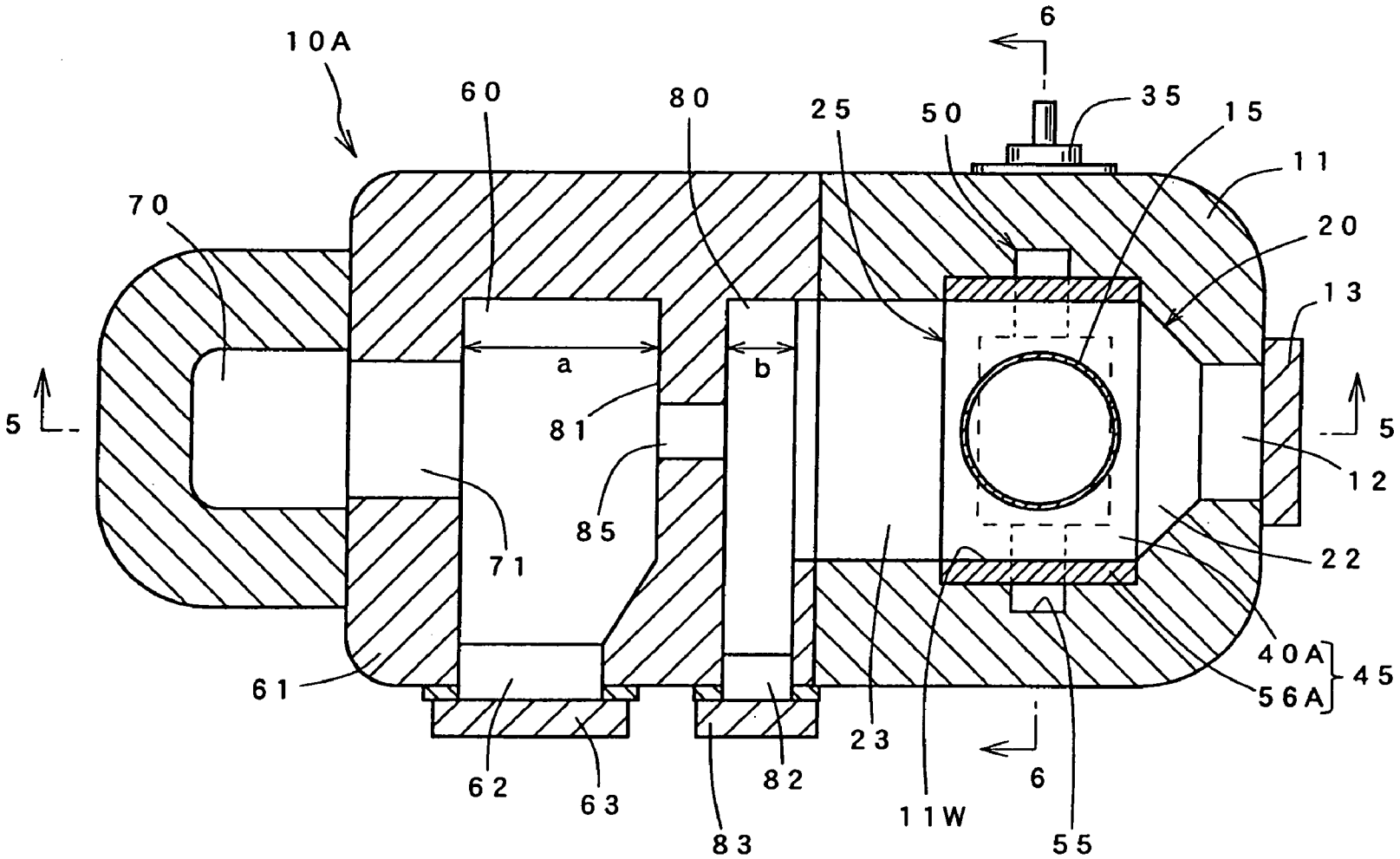
FIG. 6 is a general schematic cross-sectional view of a metal melting furnace according to another embodiment of the present invention.

Further, in the metal melting furnace 10 of this embodiment, as can be better understood from FIGS. 3–5, the outlet 52 of the exhaust gas outflow passage 50 formed in the side wall 11W of the melting chamber 20 is opened toward the side surface of the melted material holding member 15. When the outflow passage 50 is formed as described above, the exhaust gas flowing out from the combustion chamber 30 through the outflow passage 50 can preheat the melted material holding member 15 from outside and, at the same time, the melted material holding member 15 can also be preheated from inside by the exhaust gas discharged from the melting chamber 20 to the outside of the furnace and, therefore, the entire melted material held in the melted material holding member 15 can be preheated more efficiently. Further, because a plurality (two in this embodiment) of outflow passages 50 are formed, the melted material holding member 15 can be preheated from multiple directions and the preheating efficiency can be improved.

In the metal melting furnace 10 configured as described above, when the material to be melted is inserted through the material input port 21 of the melting chamber 20 onto the heating plate 40 of the hearth section 25 and, on the other hand, the melting burner 35 burns in the combustion chamber 30 to heat the heating plate 40, the material adjacent to the hearth section 25 (the heating plate 40) can be heated and melted. At the same time, as the exhaust gas flows out from the combustion chamber 30 through the outflow passage 50 to preheat the inside of the melting chamber 20, the entire material can be preheated and melted and, therefore, the preheating efficiency of the melted material can be improved significantly. In this embodiment, fuel consumption can be improved by about 10–15% in comparison with conventional metal melting furnaces.

Further, in this metal melting furnace 10, because the melting burner 35 is separated from the melted material by the heating plate 40, sherbet-like half-melted material can be prevented from being scattered to deposit as oxides on the surface around the melting burner 35 and the inside thereof and, therefore, operations that have been performed regularly hitherto for removing such oxides become unnecessary and the time for cleaning the inside of the furnace can be reduced. In comparison with the conventional metal melting furnace that needed about 5–10 minutes to clean the inside of the furnace, the time for cleaning can be reduced to about 1 minute in the metal melting furnace 10 according to this embodiment of the present invention.

On the other hand, the molten material holding section 60 may have any configuration so long as the melted material (the molten material M) that is heated and melted in the melting chamber 20 can be kept at a predetermined temperature by a holding burner 65 and, for example, as shown in the figures, the molten material processing section 80 may be formed by providing a partition section 81 between the hearth section 25 of the melting chamber 20 and the molten material holding section 60. In the figures, there are shown a furnace wall 61 defining the molten material holding section 60, an inspection hole 62 formed on the furnace wall 61, a door 63 of the inspection hole 62, a molten material discharge section 70, a communicating opening 71 formed at the bottom of the partition between the molten material holding section 60 and the molten material discharge section 70, an inspection hole 82 of the molten material processing section 80, a door 83 of the inspection hole 82, a molten material communicating section 84 formed at the bottom of partition section 81 between the molten material holding section 60 and the molten material processing section 80, and an exhaust gas communicating section 85 formed at the upper part of the partition section 81 to extend from the molten material holding section 60.

As shown in FIG. 2, the molten material processing section 80 is configured so that the melted material flowing down from the hearth section 25 along the inclined floor 23 does not flow into the molten material holding section 60 directly but it is stored once and then flows into the molten material holding section 60 via the molten material communicating section 84 at the bottom of the partition section 81. By providing the molten material processing section 80, impurities such as various metal oxides that may be generated as the material is melted can be collected on the surface of the molten material M before the impurities diffuse into the molten material M and, therefore, the impurities can be removed easily. Therefore, it is possible to allow only the clean molten material M to flow into the molten material holding section 60 via the molten material communicating section 84 at the bottom of the partition section 81 and, as a result, the cleanness of the molten material M in the molten material holding section 60 can be improved and, thus, the high quality of the molten material supplied to dies and the like through the discharge section 70 can be maintained.

In terms of elimination of the impurities, it is preferable that this molten material processing section 80 has relatively small size as shown in FIGS. 2 and 4 and, in this embodiment, the length b of the molten material processing section 80 is 200 mm (1000 mm in width) while the length a of the molten material holding section 60 is 500 mm (1000 mm in width) or, in other words, the size of the molten material processing section 80 is half or less of that of the molten material holding section 60. Further, because heavy metal oxides in the impurities may settle through the molten material M and deposit on the bottom surface of the molten material processing section 80 for a long time, it is preferable that the molten material communicating section 84 at the bottom of the partition section 81 is formed at a position higher than the bottom surface of the molten material processing section 80 and, in this embodiment, the bottom side of the molten material communicating section 84 is positioned 100 mm higher than the bottom surface of the molten material processing section 80.

The exhaust gas communicating section 85 at the upper part of the partition section 61 allows the exhaust gas from the molten material holding section 60 to flow through the entire furnace for effective utilization. The heat of the holding burner 65 disposed in the molten material holding section 60 keeps the molten material M in the molten material holding section 60 at a predetermined temperature and, thereafter, in the form of exhaust gas, flows out from the communicating section 85 of the partition section 81 into the molten material processing section 80 and the melting chamber 20 and, then, the heat is discharged to the outside through the material input port 21 that also acts as an exhaust port. While the exhaust gas communicating section 85 of this embodiment is formed as a cylinder of 150 mm in diameter, it may be designed to have any appropriate shape and dimensions. If needed, all of the upper part of the partition section 81 may be opened to function as the exhaust gas communicating section 85. Here, it is to be understood that the exhaust gas communicating section 85 should be formed at a position higher than the surface level of the molten material M.

As described above, when the molten material processing section 80 is formed by providing the molten material holding section 60 with the partition section 81, the impurities flowing into the molten material holding section 60 can be reduced significantly and, therefore, operations for removing the impurities can be facilitated and the working efficiency can be improved. For example, so long as the impurities are removed from the molten material processing section 80 regularly, the impurities can be substantially prevented from flowing into the molten material holding section 60 and the need for flux treatment in the molten material holding section 60 can be substantially eliminated. Further, the impurities deposited on the bottom surface of the molten material processing section 80 for a long time may be removed at the time of cleaning of the furnace that is performed every several months.

Next, with reference to FIGS. 6–9, a metal melting furnace 10A according to another embodiment will be described. In this metal melting furnace 10A, a side wall member 56A and a heating plate 40A are formed integrally as a heating member 45 that has a U-shape when viewed from the side and the heating member 45 is disposed in the furnace main body 11. In the following description, reference numerals identical to those in the embodiment described above designate like elements and the descriptions of these elements will be omitted.

Figure 8:
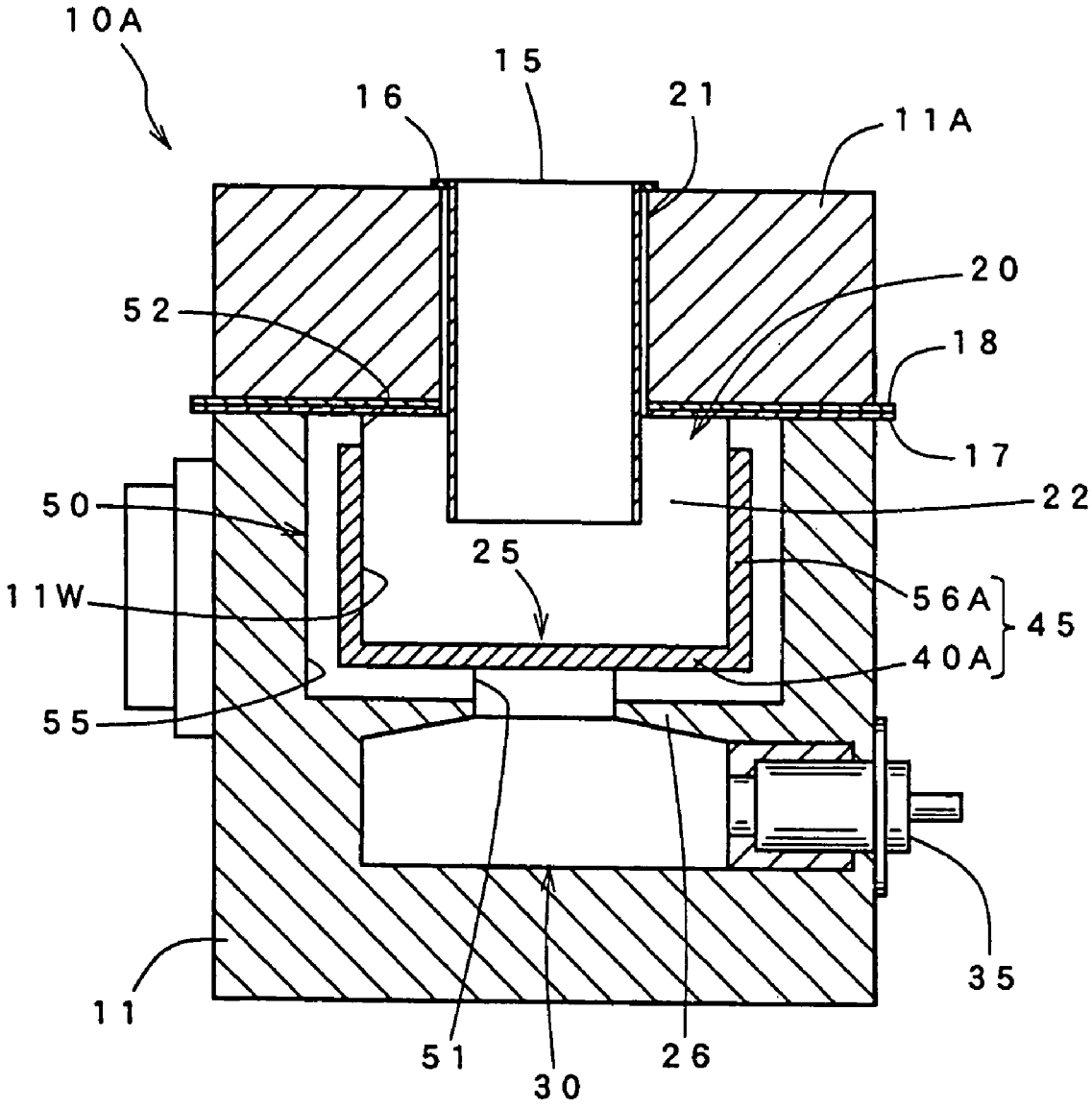
FIG. 8 is a cross-sectional view taken along the line 6—6 in FIG. 6.
Figure 9:
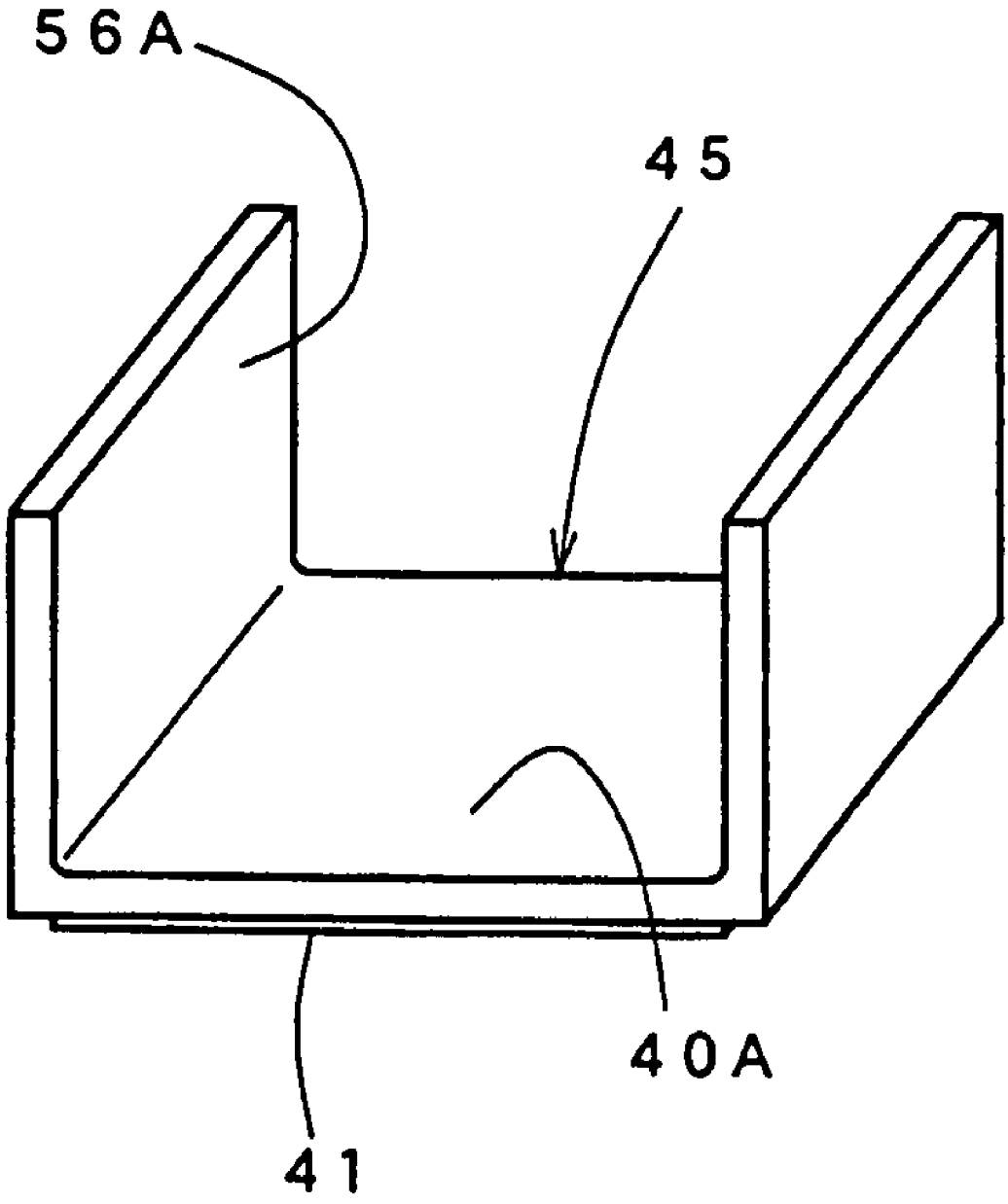
FIG. 9 is a perspective view of a heating member that has a U-shape when viewed from the side.
Figure 10:
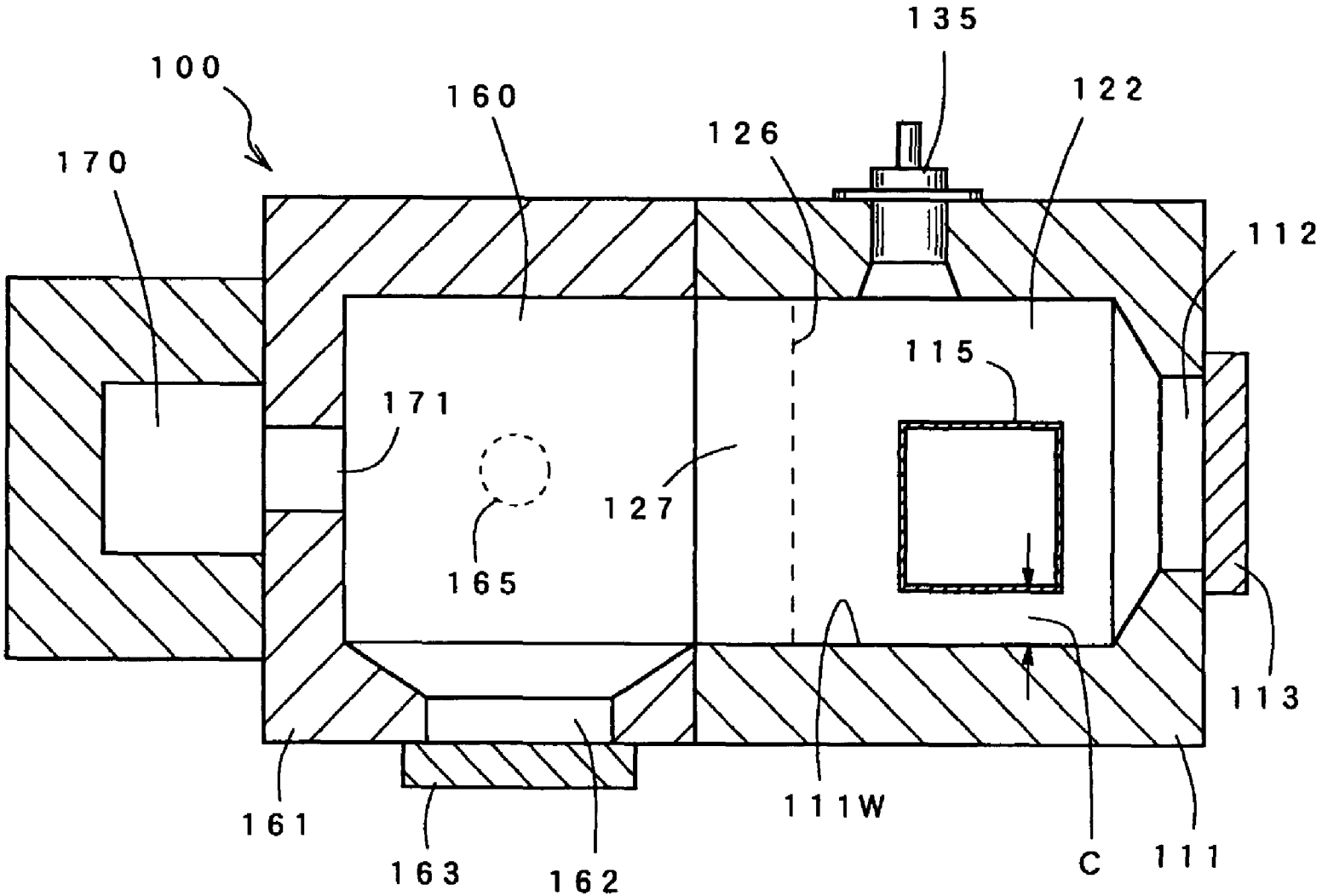
FIG. 10 PRIOR ART
FIG. 10 is a general schematic cross-sectional view showing an example of a conventional metal melting furnace.
Figure 11:
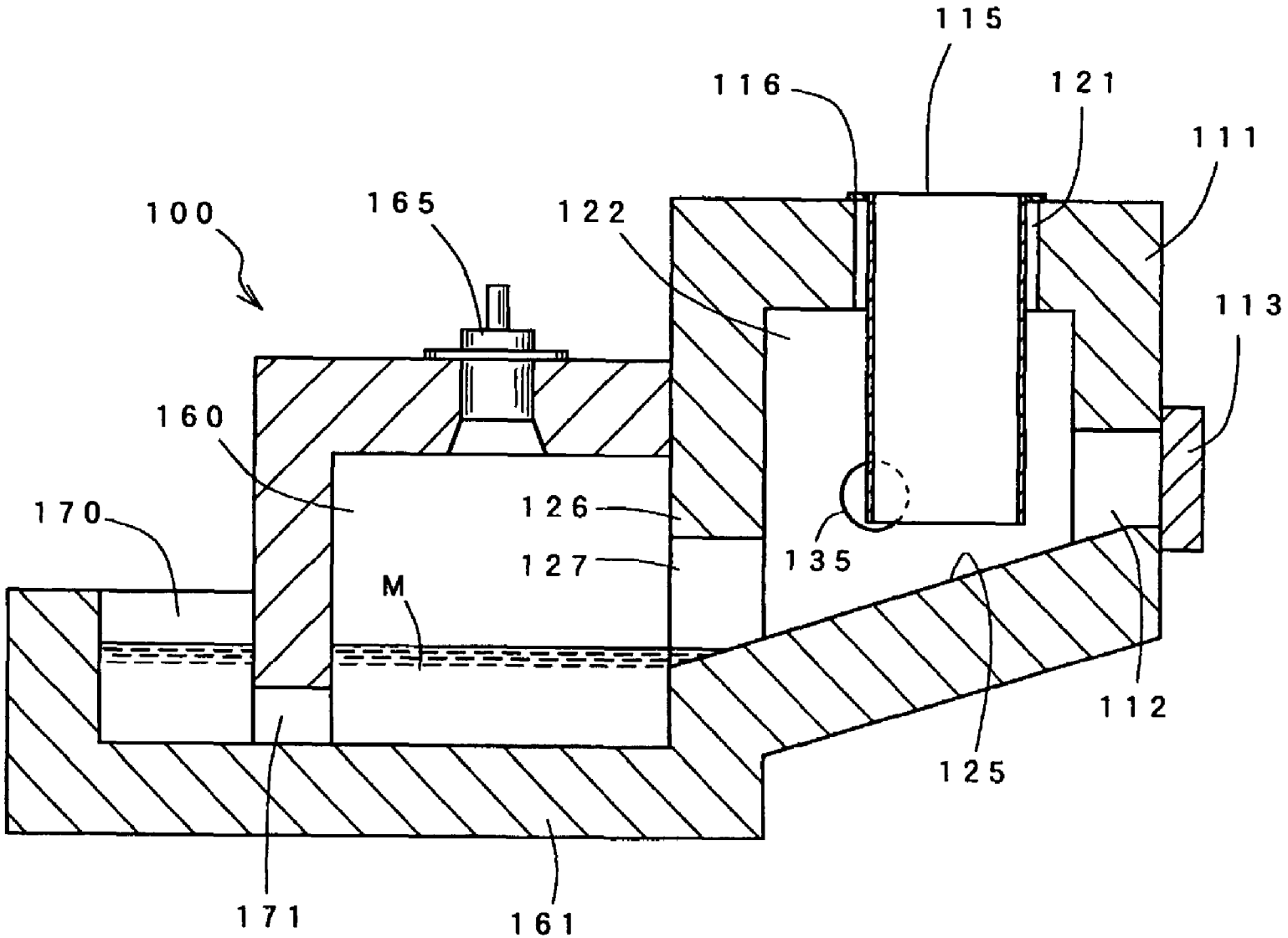
FIG. 11 PRIOR ART
FIG. 11 is a general schematic longitudinal cross-sectional view of FIG. 8.
Figure 12:
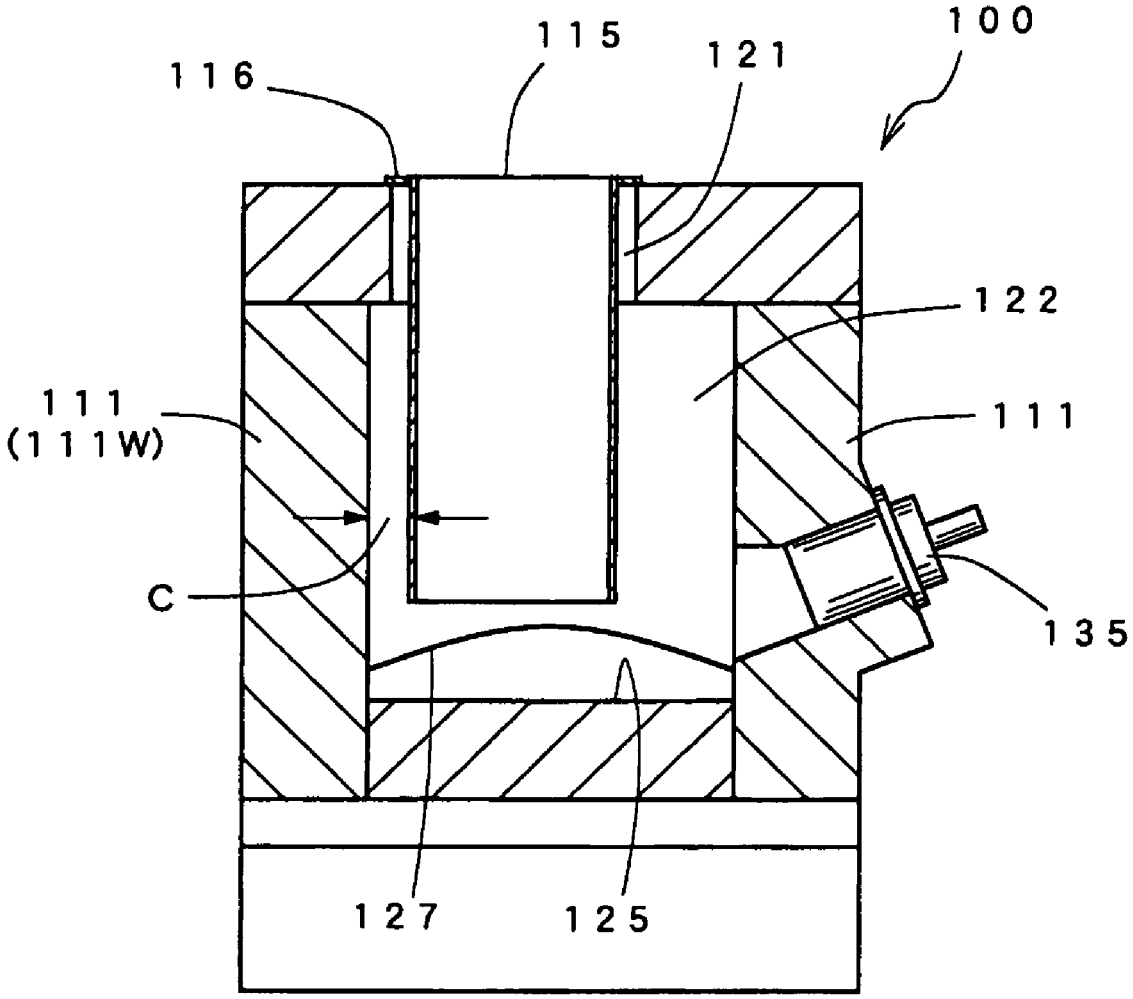
FIG. 12 PRIOR ART
FIG. 12 is a longitudinal cross-sectional view of a preheating flue in FIG. 8.

As is apparent from FIGS. 8 and 9, in the heating member 45, the side wall member 56A and the heating plate 40A are formed integrally to have a U-shaped cross section when viewed from the side and the side wall member 56A also acts as the side wall 11W of the melting chamber 20. Therefore, the melting chamber 20 can be constructed very easily and reliably and the manufacturing costs can be reduced. In addition, because the heating plate 40A and the side wall member 56A are formed integrally, the heating member 45 can be disposed on the hearth section 25 (a mount section 26) of the furnace main body 11 so that there is no clearance between the heating plate 40A and the side wall 11W of the melting chamber 20 and the melted material can be prevented from leaking from the melting chamber 20.

Further, in this heating member 45, both the side wall member 56A acting as the side wall 11W of the melting chamber 20 and the heating plate 40A can be formed of an identical material. For example, the heating member 45 can be formed integrally of a heat-resistant plate having high heat conductivity made of silicon carbide (SiC), silicon nitride ($Si_3N_4$) and the like and, therefore, preheating can be performed efficiently through the side wall 11W of the melting chamber 20 (the side wall member 56A) and the heating plate 40A, as in the case of the metal melting furnace 10 described above. In addition, because the thickness of the side wall 11W can be reduced in comparison with the case in which the sidewall 11W is formed of bricks and the like, heat insulation can be provided, such as by providing a known heat insulating plate (not shown) at the outside of the outflow passage 50 of the furnace main body 11 and, as a result, heat dissipation from the surface of the furnace body can be reduced.

Further, in the heating member 45, as shown in FIG. 9, a reinforcing plate 41 made of stainless steel (heat-resistant cast steel) and the like may be provided on the undersurface of the heating plate 40A to improve the durability of the heating member 45. Here, though not shown, it is preferable that a plurality of small holes are formed in the reinforcing plate 41.

Figure 7:
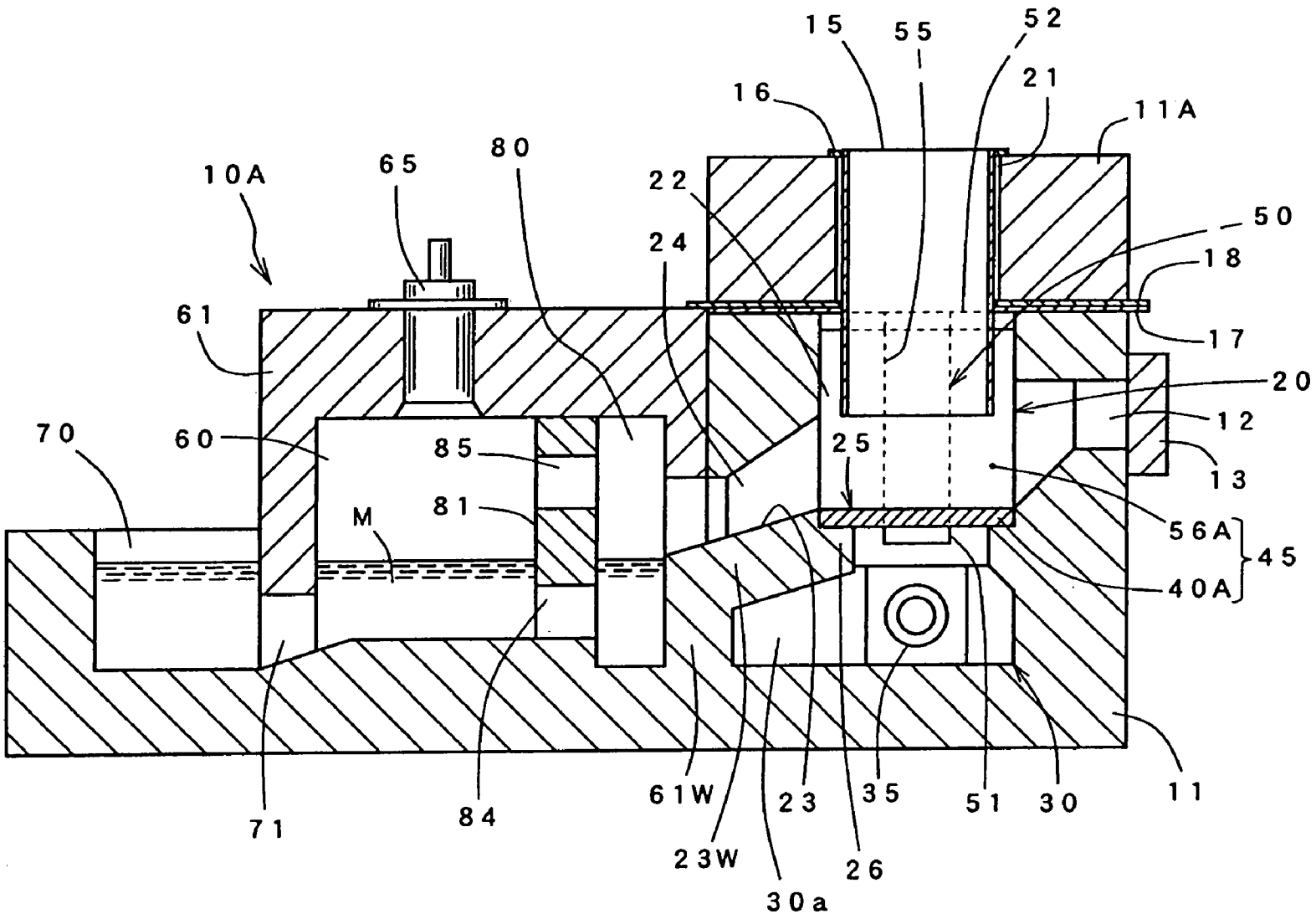
FIG. 7 is a cross-sectional view taken along the line 5—5 in FIG. 6.

On the other hand, in this metal melting furnace 10A, as well understood from FIGS. 7 and 8, the furnace upper part 11A above the outlet 52A of the outflow passage 50 that is formed at the upper part of the side wall member 56A can be separated from the furnace main body 11 and, when the furnace upper part 11A is separated from the furnace main body 11, the heating member 45 can be detached from the furnace main body 11. In this embodiment, as shown in the figures, attachment members 17 and 18 are formed at the top of the furnace main body 11 and at the bottom of the furnace upper part 11A, respectively, to be fixed to each other by using bolts (not shown) and the like. Further, in the shown example, the outlet 52A of the outflow passage 50 is opened across the total width of the upper part of the side wall member 56A and, when the furnace upper part 11A is separated from the furnace main body 11, the melting chamber 20 above the hearth section 25 is opened completely and, therefore, the heating member 45 can be detached very easily. As a result, when the heating plate 40A or the side wall member 56A is damaged or otherwise fails, the heating member 45 can be replaced very easily and the working efficiency can be improved. The maintainability of the melting furnace itself can also be improved significantly.

The metal melting furnace of the present invention is not limited to the configurations described in the above embodiments, but it may include various changes without departing from the spirit of the invention.

What is claimed is:

1. A metal melting furnace comprising a melting chamber that has a material charging port and a flue at the top and a hearth section along which melted material flows down to a molten material holding section at the bottom, wherein a combustion chamber equipped with a melting burner is formed below said hearth section, a heating plate comprised of a heat-resistant plate having high heat conductivity is disposed in said hearth section above the combustion chamber at a bottom of said flue, said heating plate disposed between said combustion chamber and said flue thereby isolating said combustion chamber and said flue from direct fluid communication with one another, and an exhaust gas outflow passage is formed in a side wall of said melting chamber, said exhaust gas outflow passage having an inlet disposed in said combustion chamber and an outlet disposed in said flue so that said combustion chamber and said flue are in fluid communication with one another via the exhaust gas outflow passage.

2. A metal melting furnace as set forth in claim 1, wherein said exhaust gas outflow passage is formed by a groove section provided on the side of a furnace main body and a side wall member and the outlet is formed at the top of said side wall member.

3. A metal melting furnace as set forth in claim 2, wherein said side wall member and said heating plate are formed integrally as a heating member that has a U-shape when viewed from the side and the heating member is disposed in the furnace main body.

4. A metal melting furnace as set forth in claim 3, wherein a furnace upper part above the outlet at the top of said side wall member can be separated from said furnace main body and, when said furnace upper part is separated from the furnace main body, said heating member can be detached from the furnace main body.

5. A metal melting furnace as set forth in claim 1, wherein a melted material holding member, the bottom of which is opened from said flue to the melting chamber, is provided.

6. A metal melting furnace as set forth in claim 1, wherein a partition section is provided between said hearth section and the molten material holding section to store molten material temporarily so that impurities such as metal oxides are collected on the surface of the molten material, and a molten material processing section is provided for supplying clean molten material through a molten material communicating section at the bottom of the partition section.

7. A metal melting furnace as set forth in claim 6, wherein a bottom surface of said molten material processing section is formed at a level lower than a bottom surface of the molten material holding section and the bottom surface of said molten material holding section is formed at a level substantially flush with a bottom side of said molten material communicating section.

8. A metal melting furnace as set forth in claim 7, wherein an exhaust gas communicating section is formed at the upper part of said partition section to extend from said molten material holding section.

* * * * *